United States Patent [19]

Duke

[11] 4,333,406

[45] Jun. 8, 1982

[54] ANCHORING MEANS FOR REFRACTIVE BLOCKS

[76] Inventor: Max E. Duke, 3311 S. Shore Dr., Humble, Tex. 77338

[21] Appl. No.: 271,630

[22] Filed: Jun. 8, 1981

Related U.S. Application Data

[63] Continuation of Ser. No. 85,244, Oct. 16, 1979, abandoned.

[51] Int. Cl.[3] ..... F23M 5/02

[52] U.S. Cl. ..... 110/340; 110/336

[58] Field of Search ..... 110/336, 338, 172, 182.5, 110/340; 52/509, 506, 606

[56] References Cited

U.S. PATENT DOCUMENTS

| | | | |
|---|---|---|---|
| 1,957,098 | 5/1934 | Denny | 110/336 |
| 2,341,777 | 2/1944 | Hensel | 52/509 X |
| 4,250,678 | 2/1981 | Skuran | 52/509 X |

*Primary Examiner*—Edward G. Favors

*Attorney, Agent, or Firm*—Bertram H. Mann

[57] ABSTRACT

A refractive block of ceramic material as a burner block or the like for furnace walls, is provided with a surrounding rib with recesses. A frame of suitably rigid and refractive angle bars encompasses the block and receives bolts extending transversely through the recesses and into or through the furnace wall. The bolts are anchored in both the frame and furnace wall and bear against the block inner face for securing the block in position, avoiding the danger of spawling or breaking out the block.

4 Claims, 4 Drawing Figures

ANCHORING MEANS FOR REFRACTIVE BLOCKS

RELATED APPLICATION

This application is a continuation of my copending application, Ser. No. 085,244, filed Oct. 16, 1979 now abandoned.

BACKGROUND OF THE INVENTION

The usual means for anchoring burner or other ceramic or frangible block to a furnace wall, other than cementing, having obvious disadvantages, utilizes bolts seated in the refractive material itself (see, for instance, Blaha U.S. Pat. No. 2,532,990). Such anchoring means is not very durable because of the danger of the bolts loosening by turning or breaking out of or spawling the ceramic material creating leakage.

SUMMARY OF THE INVENTION

The main object of the invention is to provide anchoring means for refractory blocks of ceramic material attached to the interior furnace walls, which means does not rely upon the integrity of the ceramic material itself for firm anchoring of the block and, thus, avoids the problems of spawling, loosening, and breakage of attaching elements incurred in previous arrangements for the purpose.

In accordance with the invention, the ceramic block is provided with a surrounding integral rib having transverse recesses or slots. Angle bar framing rests against outward faces of the block and carries bolts which extend along opposed sides of the block and through the rib recesses and supporting furnace wall. The bolts secure the framing and block between the bolt heads and nuts on the ends of the bolts.

DETAILED DESCRIPTION OF THE DRAWINGS

Figure 1:
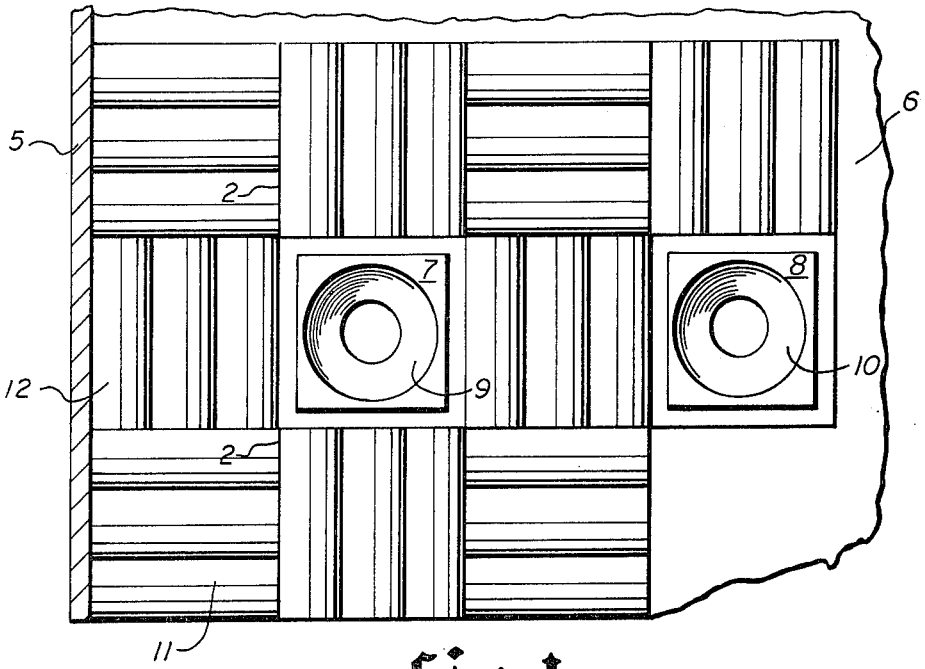
FIG. 1 is an inside elevation of a part of a furnace wall showing burner blocks and intervening refractory blankets mounted thereon.

FIG. 1 shows a portion of the refractory-lined inner surface of a furnace having a side wall 5 and an intersecting wall 6 on which are mounted refractory, ceramic burner blocks 7 and 8, each with a burner port, as 9 and 10. These blocks may be disposed on the furnace wall in any suitable arrangement. Between the blocks are tightly packed, convoluted refractory blankets, as at 11 and 12, secured to the wall 6, for instance, as disclosed in my copending application Ser. No. 009,076, filed Dec. 3, 1979.

Figure 2:
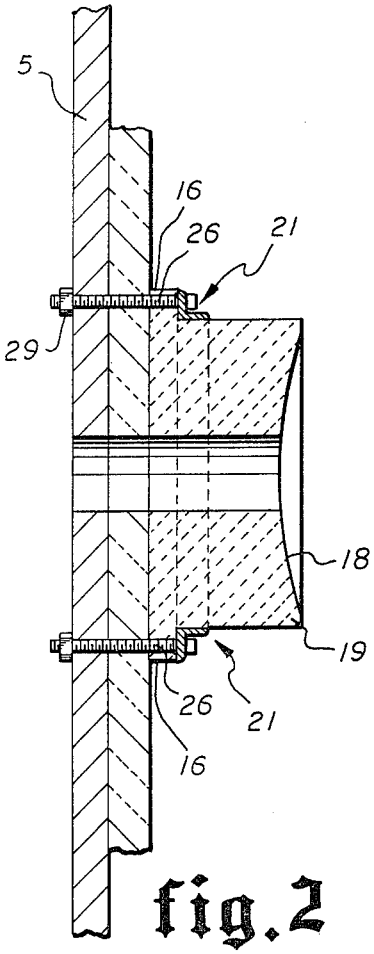
FIG. 2 is a section taken substantially on line 2—2 of FIG. 1 with the blocks shown inside elevation and the refractive blankets omitted.
Figure 3:
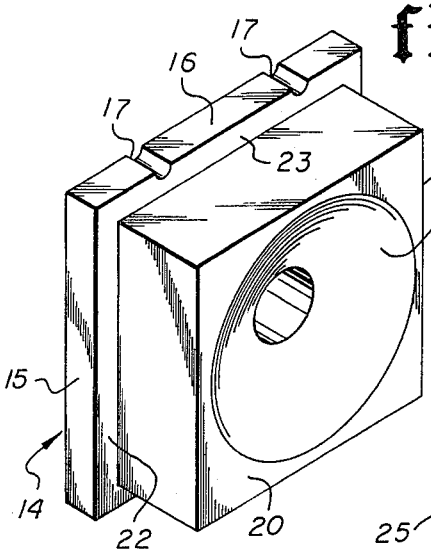
FIG. 3 is an isometric view of the burner block with the anchoring framing removed.
Figure 4:
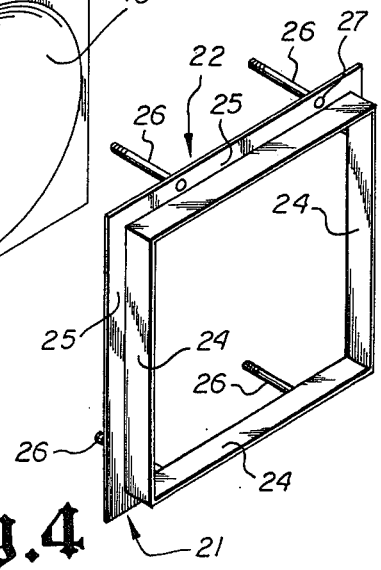
FIG. 4 is an isometric view of the anchoring framing and bolts, removed from the block.

The blocks are individually anchored in place by framing and bolts, as shown in FIGS. 2, 3, and 4. Each block has an integral surrounding rib 14 with side and end portions 13 and 16, at least the end portion 16 having spaced recesses or slots 17. Burner port 18 extends axially through the block body 19 from the inner face thereof.

The anchoring framing generally designated 21, is of angle bar, heat resistant, preferably integral material including axial and outstanding flanges 24 and 25. The framing is shaped to closely encompass the block body 19. Bolt holes 27 are provided, in this instance, in one pair of opposed outstanding flanges 25 to receive bolts 26 in alignment with rib recesses 17 and accommodating holes 28 in furnace wall 6. Nuts 30 threaded on the bolts maintain the assembly.

In anchoring the blocks, the furnace wall is appropriately drilled for properly positioning bolts 26 and blocks 7. Framing 21 is slid on and about the block body and sealed on the inner face of rib 14 with the bolts extending through recesses 17 in the guiding and stabilizing rib 14 and also through furnace wall holes 28. Nuts 30 are then threaded and tightened on the protruding bolt ends to draw framing 21 against the inward faces 22 and 23 of the rib, thus firmly anchoring the block in position.

It is especially notable that no part of the anchoring means (framing 21 and bolts 26) is lodged or buried in the ceramic material of the block, even recesses 17 sufficiently loosely receiving the bolts so there is substantially no tendency to cause spawling or breaking of the material.

The invention may be advantageously used in anchoring other bodies of ceramic or other frangible materials, for instance, furnace inspection port framing, and elongate elements other than bolts may be used.

I claim:

1. The combination of a refractory burner block of frangible material having an inner, heat exposed face and side walls with rib-like lateral extensions for accommodating other insulating material in protective contact with said side walls, of burner block anchoring means comprising angle bar framing with flanges facing and abutting said side walls and other flanges resting against inward faces of said rib-like extensions, and means for securing said latter flanges and said framing to a support in position for protection by said other insulating material.

2. The combination described in claim 1 in which the periphery of said block and said framing form closed figures whereby said framing secures and stabilizes said block.

3. Means for anchoring a frangible body as described in claim 1 in which said body is formed of ceramic refractory material.

4. A burner block as described in claim 2 in which said block is of unitary construction forming substantially a complete burner opening.

* * * * *